US007059140B2

(12) United States Patent
Zevlakis

(10) Patent No.: US 7,059,140 B2
(45) Date of Patent: Jun. 13, 2006

(54) LIQUID MILK FREEZE/THAW APPARATUS AND METHOD

(76) Inventor: John Zevlakis, 21-09 19th St., Long Island City, NY (US) 11105

( * ) Notice: Subject to any disclaimer, the term of this patent is extended or adjusted under 35 U.S.C. 154(b) by 0 days.

(21) Appl. No.: 10/864,541

(22) Filed: Jun. 10, 2004

(65) Prior Publication Data

US 2004/0237564 A1 Dec. 2, 2004

Related U.S. Application Data

(63) Continuation-in-part of application No. 10/612,458, filed on Jul. 2, 2003, now Pat. No. 6,920,764, which is a continuation-in-part of application No. 10/068,952, filed on Feb. 9, 2002, now Pat. No. 6,588,219.

(60) Provisional application No. 60/339,855, filed on Dec. 12, 2001.

(30) Foreign Application Priority Data

Dec. 9, 2002 (WO) ..... PCT/US02/39679

(51) Int. Cl.
*F25C 1/04* (2006.01)

(52) U.S. Cl. ..... 62/66; 62/340; 62/356

(58) Field of Classification Search ..... 62/66–74, 62/340–356; 426/249, 524, 580
See application file for complete search history.

(56) References Cited

U.S. PATENT DOCUMENTS 1,781,541 A 11/1930 Einstein
1,852,064 A 4/1932 Rosenberg
1,977,608 A 10/1934 Blystone
2,069,567 A 2/1937 White
2,112,263 A 3/1938 Bohannon
2,586,588 A 2/1952 Weseman
2,941,377 A 6/1960 Nelson (Continued)

OTHER PUBLICATIONS

Cool Process Promises Better Dairy Products-, Cornell News: Ice-Filtered Milk; www.new.cornell.edu/chronicle/98/4.30.98/ice-milk.html, Apr. 30, 1998, 2 page website.

*Primary Examiner*—William E. Tapolcai
(74) *Attorney, Agent, or Firm*—Alfred M. Walker; Lee Grosskreuz Hechtel

(57) ABSTRACT

A high throughput, short batch cycle commercial ice making machine produces salt containing, milk containing or beverage containing commercial ice, which resists melting in convenient sizes for mobile food carts, market produce, or fish displays. The machine introduces super-cooled liquid, that is in a liquid state while exposed to a temperature below freezing, into a batch of pre-formed hollow molds of one or more horizontally oriented ice forming freezing trays oriented horizontally. Using vapor compression refrigeration, the machine produces a plurality of supercooled ice segments in pockets within the freezing tray. The supercooled ice segments are rapidly subjected to a short, temporary contact with a high heat source from a sleeve integral with the freezing tray compartments, along a peripheral bottom surface of the ice segment accommodating freezing tray molds. This temporarily melts a bottom surface of each ice segment, lubricating it and loosening it. Then the machine rotates the freezing tray containing the batch of ice segments about its horizontally oriented axis to a vertically oriented dump position, thereby dumping the temporarily heated ice segments into the freezing tray. The ice cubes thus formed may be fresh water, salt water or beverage containing ice cubes.

14 Claims, 11 Drawing Sheets

U.S. PATENT DOCUMENTS

| | | | | |
|---|---|---|---|---|
| 3,003,327 | A | 10/1961 | Cox | |
| 3,130,556 | A | 4/1964 | Goldsborough | |
| 3,220,214 | A | 11/1965 | Cornelius | |
| 3,318,105 | A | 5/1967 | Burroughs | |
| 3,430,452 | A | 3/1969 | Dedricks | |
| 3,775,992 | A | 12/1973 | Bright | 62/73 |
| 3,913,349 | A | 10/1975 | Johnson | 62/352 |
| 3,959,981 | A | 6/1976 | Anderson | 62/135 |
| 4,048,815 | A | 9/1977 | Kattis | 62/354 |
| 4,055,053 | A | 10/1977 | Elfring | 62/3 |
| 4,199,956 | A | 4/1980 | Lunde | 62/138 |
| 4,255,941 | A | 3/1981 | Bouloy | 62/347 |
| 4,366,679 | A | 1/1983 | Van Steenburgh | 62/347 |
| 4,420,949 | A | 12/1983 | Bartholmey et al. | 62/354 |
| 4,459,824 | A | 7/1984 | Krueger | 62/347 |
| 4,474,023 | A | 10/1984 | Mullins | 62/137 |
| 4,505,943 | A | 3/1985 | Dell | 426/565 |
| 4,532,772 | A | 8/1985 | Makinen | 62/74 |
| 4,580,410 | A | 4/1986 | Toya | 62/347 |
| 4,628,698 | A | 12/1986 | Needham | 62/137 |
| 4,671,077 | A | 6/1987 | Paradis | 62/324.1 |
| 4,774,814 | A | 10/1988 | Yingst | 62/126 |
| 4,832,972 | A | 5/1989 | Toledo-Flores et al. | 426/327 |
| 4,936,102 | A | 6/1990 | Goldstein et al. | 62/66 |
| 4,942,742 | A | 7/1990 | Burruel | 62/347 |
| 5,035,733 | A | 7/1991 | Goldstein | 62/541 |
| 5,218,830 | A | 6/1993 | Martineau | 62/73 |
| 5,300,246 | A | 4/1994 | Yamamoto et al. | 252/70 |
| 5,582,754 | A | 12/1996 | Smith | 219/438 |
| 5,666,819 | A | 9/1997 | Rockenfeller | 62/480 |
| 5,918,477 | A | 7/1999 | Gall et al. | 62/354 |
| 5,997,936 | A | 12/1999 | Jimenez-Laguna | 426/565 |
| 6,099,208 | A | 8/2000 | McAlister | 405/217 |
| 6,233,964 | B1 | 5/2001 | Ethington | 62/344 |
| 6,383,533 | B1 | 5/2002 | Soeda | 426/56 |
| 6,716,461 | B1 | 4/2004 | Miwa | 426/34 |
| 2002/0197355 | A1 | 12/2002 | Klein | 426/101 |
| 2004/0079104 | A1 | 4/2004 | Antognoni | 62/354 |

LIQUID MILK FREEZE/THAW APPARATUS AND METHOD

RELATED APPLICATIONS

This application is based in part upon application Ser. No. 10/612,458 filed Jul. 2, 2003, now U.S. Pat. No. 6,920,764 which is based in part upon application Ser. No. 10/068,952, filed on Feb. 9, 2002, now U.S. Pat. No. 6,588,219 which claims the benefit under 35USC 119(e), of provisional patent application Ser. No. 60/339,885, filed on Dec. 12, 2001.

FIELD OF THE INVENTION

The present invention relates to making ice cubes from liquids such as milk, milk products such as yogurt, fresh water, salt water or sweetened beverage, in a horizontally oriented freezing tray having refrigerant and evaporator conduits integral with, and in intimate contact with, the ice cube mold compartments of a freezing tray, so that the resultant ice cubes have a long shelf life before melting, and wherein separation of the components of the liquid is minimized, so that the resultant ice cubes may later be melted to a liquid state where the resultant liquid has the same taste and/or consistency of the original liquid before it was frozen.

BACKGROUND OF THE INVENTION

Many ice making machines make ice in vertically oriented freezing trays. In vertical dripping, the later dripped water freezes differently than the earlier dripped water in a vertical cascade. In addition, freezing is inhibited because the vertical inflow of water releases more energy as the water cascades down, thus slowing the freezing time due to the activity of the flowing, cascading liquid.

Among relevant vertically oriented ice-making patents include U.S. Pat. No. 4,474,023 of Mullins for an ice-making machine. In Mullins '023, ice is formed by dripping water in vertically disposed trays, freezing the water into cubes, loosening the cubes by applying heat through adjacent evaporator conduits, then rotating the trays approximately 30 degrees downward from a vertical position, thereby dumping the formed ice cubes into a bin. Flexible hoses are used in Mullins '023 for transporting both the water and the refrigerant in order to allow pivoting of the freezing tray from the vertical water loading position to the partially facedown dumping position. Mullins '023 uses a high heat source in a cycle reversal for causing temporary loosening of the cubes from their individual molds within the tray, but the evaporator is attached to the tray, not integrally formed therewith. As a result, the tray-contacting surface of the ice cubes is not uniformly and quickly heated for a quick melt and release therefrom.

A similar ice cube-making machine with a vertically oriented freezing tray is described in U.S. Pat. No. 4,459,824 of Krueger. However, the vertical orientation of Mullins '023 and Krueger '824 increases drip inflow time, which provides a barrier to super-cooling of the water for forming the ice. U.S. Pat. No. 4,255,941 of Bouloy describes an ice-making machine, which is also vertically oriented. In Bouloy '941, there are shown two freezing trays 22 welded back-to-back, wherein the trays 22 with semi-circular molds 32 for each ice cube have spaces 48 between the trays 22 for a reverse flow of alternately flowing refrigerant and evaporator gas. The hot gas is used to melt the ice cubes 124 from their molds 32 in each of the two back-to-back freezing trays 22. The spaces 48 of Bouloy '941 are arcuate triangles formed between the rounded backs of the semi-circular molds 32 forming the ice cubes.

The disadvantage of Bouloy '941 is that since the two molds are welded back-to-back, at the weld seams between the two molds each labeled 22, the refrigerant, and alternately the hot gas, can not flow through these closed seams, so there is not uniform intimate contact of the hot gas with the bottom of each ice cube mold 32 of each of the freezing trays 22.

The U.S. Pat. No. 4,199,956, of Lunde describes an ice cube-making machine, which requires an electronic sensor to interrupt the freezing cycle to thaw the cubes for dumping.

The U.S. Patent Publication, No. 2004/0079104 A1, of Antognoni describes an ice making apparatus for making salt water ice shavings for packing fish aboard a marine vessel. The salt water is not supercooled to a temperature from below minus 100° F. to minus 50° F., nor is it minimally heated to be released from ice forming molds.

The U.S. Pat. No. 6,233,964, of Ethington describes an ice cube-making machine with a freezing cycle and a hot gas defrost valve used with a detector for detecting frozen ice. Ethington '964 is similar to conventional ice making machines in hotels and other commercial establishments.

Among other US patents for loosening frozen ice cubes from a tray ice include U.S. Pat. No. 3,220,214 of Cornelius for a spray type ice cube maker. Moreover, patents which heat trays for loosening ice cubes include U.S. Pat. No. 5,582,754 of Smith, which uses electrical heating elements to thaw semi-circular ice cubes from a freezing tray; U.S. Pat. No. 1,852,064 of Rosenberg, U.S. Pat. No. 3,318,105 of Burroughs, U.S. Pat. No. 2,112,263 of Bohannon U.S. Pat. No. 2,069,567 of White and U.S. Pat. No. 1,977,608 of Blystone also use electrical heating elements to thaw cubic ice cubes from a freezing tray. In Bohannon '263, Burroughs '105 and White '567, the electrical heating elements are arrayed in longitudinally extending heating elements which extend adjacent to the sides and bottoms of ice cube freezing tray ice cube forming compartments, but the heating elements do not provide uniform heat all along an undersurface of each ice cube tray compartment.

U.S. Pat. No. 2,941,377 of Nelson uses serpentine conduits of evaporation fluid for loosening ice cubes, but only along the sides of the ice cube tray molds. U.S. Pat. No. 1,781,541 of Einstein, U.S. Pat. No. 5,218,830 of Martineau and U.S. Pat. No. 5,666,819 of Rockenfeller and U.S. Pat. No. 4,055,053 of Elfving describe refrigeration units or ice making machines which utilize heat pumps for alternate heat and cooling.

Therefore, the prior art patents have the disadvantage of not allowing for supercooling of water on a horizontally oriented tray, and not allowing for rapid but effective heating of all of the undersurface of each ice cube from adjacent evaporator conduits conforming to the surface of the ice cube forming tray compartment molds, to provide only a slight melting of the undersurface of each ice cube for lubricating each cube prior to dumping in a supercooled state into a collection harvesting bin. Furthermore, among the vertically oriented ice making machines such as of Mullins '023 or Bouloy '941, there is no way to use the freezing trays horizontally as a display counter, such as in a retail store.

In addition, U.S. Pat. No. 6,716,461 of Miwa discloses freezing milk in a freeze dry process, but includes the step of adding the enzyme transglutiminase to the raw milk before freezing and U.S. Pat. No. 6,383,533 of Soeda also discloses treating milk with enzymes, such as transglutiminase. U.S. Patent Publication, No. 2002/0197355, of Klein describes a frozen beverage topping that blends edible fats, water and dry ingredients to produce a frozen cappuccino froth product. U.S. Pat. No. 5,997,936 of Jimenez-Laguna describes forming a milk concentration, freezing the milk at −18° C. (−0.4° F.) and adding a gas to make a foamed milk based product.

OBJECTS OF THE INVENTION

It is therefore an object of the present invention to provide super-cooled ice cubes, formed of various liquids, with a long shelf life before melting, and to improve over the disadvantages of the prior art.

It is also an object of the present invention to make stable, milk and milk product ice cubes or sweetened beverage ice cubes.

It is yet another object of this invention to maximize the use of a horizontally oriented freezing tray of an ice making machine, wherein the horizontally oriented freezing tray has integral hollow sleeves in intimate contact with the freezing tray, to facilitate the rapid freezing and discharge of the ice from the freezing tray.

Other objects which become apparent from the following description of the present invention.

SUMMARY OF THE INVENTION

In keeping with these objects and others which may become apparent, the present invention is an efficient method of producing this commodity of melt-resistant ice is described by this invention. The method and apparatus of this invention uses one or more horizontally oriented freezing trays in combination with conventional vapor compression refrigeration using common refrigerants such as, for example, "Free Environmental Refrigerant number 404A". The quality of the product is superior as the apparatus outputs ice segments that are supercooled (below or near 0 degrees F.) well below freezing temperature thus affording even more cooling capacity per pound than just the heat absorbed by the solid to liquid transition. The ice is produced in batches in horizontally oriented freezing trays, wherein the batches are then dumped automatically from the freezing trays.

Because the freezing trays are horizontally oriented, the water or other liquid, such as milk, milk products such as yogurt, beverages or salt water, is dripped at a uniform rate, unlike cascading water flowing down vertically oriented freezing trays. These horizontally oriented freezing trays can also be used as counters for displaying objects kept at cold temperatures, such as items in a retail market or grocer. Moreover, these horizontally oriented freezing trays can be stacked horizontally one on top of each other for maximum use.

Key elements of this invention that contribute to its superior performance include the design of the freezing trays which form an integral evaporator, as well as the method of dumping the ice product by rotating the tray from the horizontal to a vertical position. This rotation is facilitated by the use of flexible coolant hose connections to the freezing trays. By cycle reversal (similar to a heat pump cycle), hot refrigerant is directed into the evaporation spaces in the trays for a brief "thaw" cycle which creates a thin layer of water at the interface between the ice segment and the tray surface, thereby dislodging the ice segments, while the tray is in the vertical position, with the water layer acting as a "lubricant" to further aid in the dumping process. Since the "thaw" cycle has very high heating power causing a high temperature difference between the heated tray surface and the ice segment, this cycle is short, and the heating of the ice surface is therefore localized to a thin liquid interface layer which quickly refreezes upon being dumped due to heat transfer to the interior of the supercooled ice segment. The rapid cycle time achieved insures very good capital efficiency as the weight of ice produced per day is high with respect to the cost of the apparatus. In addition, very little maintenance is necessary for the apparatus.

Therefore, to summarize the key features, integral evaporation channels within the horizontally oriented freezing trays contribute to short freezing cycles; rotation of freezing trays is facilitated by coolant hose connections; dumping of ice product is accomplished by refrigeration cycle reversal heating freezing trays internally; product produced is convenient sized ice segments that are supercooled.

In addition to producing fresh water ice cubes, the present invention also produces non-freshwater ice cubes, wherein the substance being frozen can be milk, milk products such as yogurt, salt water or drinking beverages. For example, cubes of sweetened, or unsweetened, beverages, such as brand name soda beverages, seltzers, or teas may be used. Alcoholic beverages containing components such as alcohol, hops or malt can also be used to make ice cubes of beer or other beverages.

In addition to the beverages mentioned in the last paragraph, fresh fruit juices as well as any variety of milk or milk product such as yogurt, can be rapidly frozen by this invention to form ice cubes. The milk or milk product such as yogurt is frozen into cubes without the need for added emulsifiers or enzymes, and without condensing, drying, or concentrating the milk. Such products with suspended pulp or fat globules are resistant to acceptable freezing using conventional methods because the slower freezing process permits the suspended components to separate out of solution due to differences in freezing rate. Rapid freezing in cube form and later reconstitution as a liquid by melting produces a substance indistinguishable from the original. This is in contrast to typical frozen orange or fruit juice or to reconstituted powdered milk; these products are easily taste distinguishable from their original fresh counterparts. Especially for milk, this innovation has the potential to greatly reduce the percentage of product discarded due to spoilage. Also, very long distance shipment and transport of fresh milk in frozen form (without de-homogenization) is made feasible. It can be kept frozen for long periods without deterioration and melted or thawed to a liquid form as needed either as a bulk process at distribution centers, or sold as a frozen commodity and thawed from the home freezer at the consumer's convenience. To facilitate the rapid thawing and liquefaction of the frozen product either at a bulk distribution center or at home, a rapid liquefying method, which includes an ice shaver combined with a heated container may be preferably utilized. When liquid is conventionally frozen, its components often separate out so that the resultant liquid loses its consistency after melting; for instance, cream will tend to separate out from milk when melted from a frozen state, and conventionally frozen milk was condensed or concentrated upon liquefying. The freezing point of milk, however, is most dependant on the salt and lactose content, rather than the cream, fat, and protein content. In liquid milk, the lactose and salt are both dissolved in solution at a relatively constant concentration. The freezing point of milk is between 31.05° F. and 31.01° (−0.53° C. and −0.55° C.), and is often measured in degrees Hortvet, which is a scale used almost exclusively for milk. The Hortvet scale is a derivative of degrees Celsius, and the two scales may be converted by applying the following equation: ° C.=0.96231° H.−0.00240.

Freezing and preserving milk, as well as other foods, at very low temperatures, typically −1° F. (−18° C.) for conventional domestic freezers and from −1° F. to −20° F. (−18° C. to −29° C.) for commercial freezers is known to inhibit growth of microorganisms (i.e. bacteria), and retard enzymic and chemical activity, while, for the most part, retaining nutrients, vitamins, and other properties. Freezing preserves the milk by rendering any water in it unavailable to microorganisms by converting it to ice, although many microorganisms can survive freezing temperatures in a dormant state. The disclosed method of quickly supercooling milk or a milk product such as yogurt is ideal because this process prevents large ice crystals from forming in the cells, which could cause structural/mechanical damage. Relatively small ice crystals cause little or no damage to the structure of the cells present. A slow freezing process allows large uneven ice crystals to form that will later rupture the cells and cause the flavor, texture, and nutritional value to change when the food is thawed. Milk and other foods containing fats such as cream tend to separate when frozen slowly. Freezing has little effect on the nutritive value of the milk, as with most foods (although a small amount of vitamin C may be lost in certain blanched foods).

Frozen milk may be stored in conventional freezers to 0° F. for approximately three months. The disclosed method employs very low temperatures; this allows the milk to be frozen into cubes, and other frozen items to remain frozen safely for an extended length of time of at least six months. This extended storage time also allows shipment of the milk over great distances, including for example, to deployed military units to provide troops with safe milk products, to remote humanitarian aid stations for refugees, and/or to impoverished communities. On arrival, the frozen milk cubes may be thawed to an immediately useable state of liquid milk, without the addition of water, or any other additive, from local sources for the protection of the users. Since the frozen milk cubes thaw to useable milk without the addition of any ingredients, the risk of infection and disease is greatly lowered. Little or no mixing of the resulting milk is required since the rapid freezing does not cause separation. Extended safe frozen storage also allows shipment and trade with other communities and countries which may lack local sources of fresh milk and milk products. The apparatus and method of the present invention now allows the sale of fresh milk and milk products such as yogurt that heretofore was, at best, very difficult and costly where possible at all.

Ice made with fresh water has a temperature upon separation from the machine of preferably −20° F. The machines of the present invention produce cubes that typically weigh approximately a half-pound. A batch of fresh water ice may be completed in approximately one half hour, or less, and ice that contains salt requires twice that amount of time. The latest prototype can make some 2,000 pounds of fresh water ice in a day, or 1000 pounds of non-fresh water ice in a day. Other production models may make up to 5,000 pounds of fresh water ice in a day. These models include movable molds, and thus are able to produce ice cubes from an ounce to several pounds. This ice has been tested against wet ice now in the market and has a shelf life of at least five times longer than conventional ice in all situations. One reason for the longevity of the ice cube, and its ability to resist melting, is its large size which increases the volume to surface ratio of the cube. Another reason is that the ice produced in the present invention is supercooled, and it is then held at a temperature that is significantly lower than that of conventional freezers, and the process also has a very short thaw/release cycle.

Ordinary fresh water ice is produced in all other known icemakers, at a temperature of 30° F., just below freezing of 32° F. (0° C.) and will begin to melt when it reaches 32° F. or just above that temperature. Thus, the temperature must increase on its surface a mere two degrees before the ice begins to melt. In contrast, the ice of the present invention does not begin to melt until the temperature increases on the ice cube's surface 52 degrees, minimum from −20° F. to 32° F. In addition, the machines of the present invention can reach temperatures as low as −50° F.

Ice containing impurities, such as salt in salt water ice, sweeteners in sweetened beverage, or milk undergo endothermic reactions, which enable this ice to produce freezing temperatures. The salt water ice can be used to freeze food or retain the freezing state of the food, and ocean or saline water may be used. It is calculated, that ice that can do this is worth many times what fresh water ice is worth at wholesale. In the New York area, fresh water ice at wholesale, sells for between 7 to 10 cents a pound. In addition, the fresh water ice produced is the best refrigerant and the saltwater cube compares favorably with dry ice. Except for dry ice, a cube containing a sufficient percentage of salt is the only other known mechanical and known chemical freezing agent. The literature indicates that ice containing salt or other impurities, can be lowered in temperature to almost absolute zero. It is expected, that if lowered further than −80° C., its shelf life will be increased to a point that it lasts far longer than dry ice of equal size. It should be noted that the density of dry ice is double that of ice made with water.

Five pounds of dry ice of good quality, in the best package available, containing 20 pounds of frozen foods, will fully sublimate (change to a gas), within 4 hours, and the frozen food will start to defrost. Spoilage may follow. Dry ice of the same weight will last longer in smaller containers of equal quality having reduced amounts of frozen food, but not longer than a day. A few airlines such as Hawaiian Airlines, require that a shipper must make advance arrangements with it, if a package contains more than 5 pounds of dry ice. It is unknown if its charges substantially increase as a result of the increased amount of dry ice. Most carriers are far more restrictive. An example is American Airlines. It restricts the amount of dry ice in any package to 2 kg. Federal regulations restrict the total amount of Dry Ice carried on a plane to 440 pounds per cargo compartment. In addition, many airlines also restrict the use of wet ice. Many shippers are thus required to use gels and artificial ice. This adds to their expense. It is believed that none of these restrictions applies to the ice that the machine of the present invention can produce. Besides savings, shippers are likely to have greater freedom if ice of the present invention is used.

In comparing dry ice to salt water ice, some of the drawbacks of dry ice are: (1) that it is rated dangerous thereby having some insurance consequences; (2) its high production cost; (3) the regulations applicable to its use; (4) that it can explode if stored improperly; (5) it weighs double a like volume of ice; (6) if not of good quality, it can leave an unpleasant odor and might even effect the taste.

The machine of the present invention, produces the salt containing ice at a temperature of between −20° F. and −50° F. This means that the salt containing ice, even if never placed in a special freezer, will not begin to melt until its surface area increases in temperature by 71 degrees to about 18 to 21° F. Upon separation, the ice cube containing salt can freeze food or retain the frozen state. Its shelf life can be enhanced by placing it in a special freezer after separation from the icemaker to lower its temperature further. These cubes have been lowered to −110° F. by placing them in a special freezer. Tests were conducted recently at Washington University for these freezers are special and generally found only in certain laboratories. At this temperature the shelf life was found to be equal to dry ice.

The shelf life of the salt ice cubes can be substantially enhanced to equal or exceed that of dry ice, if placed in a cryogenic (special) freezer having a sufficiently low temperature. Upon separation from the machine, the ice cube, whether it contains fresh water, water and salt or anything else, such as milk or beverages, is between −10° F. to −50° F., depending on what is desired. In any case, no matter the temperature inside, fresh water ice is a refrigerant, not a freezing agent. Upon separation from the machine, a salt containing cube is a freezing agent. The lowered temperature of the ice does not change its use, it merely increases the shelf life of the ice.

It is reasonably expected, that in most countries the cost of potable or fresh water will substantially increase, and/or water restrictions will prevent such ice from being made regardless of cost. For these reasons, it is desirable to be able to make cooling, non-drinkable ice from sea or saline water. To a limited extent, a brine with a heavy salt concentration could be used, for example, to preserve foods. An enhanced reason for making ice that contains salt, is that it causes the ice to be far more valuable, and the best non-mechanical freezing agent.

Known machines can produce slivers of ice containing salt, and other machines that produce ice from sea or saline water, but the salt leaches and separates out, leaving a cube containing primarily fresh water. It has been ascertained, that when the salt containing ice melts, the salt separates leaving fresh water. This may provide a secondary use for the ice. For example, salt containing cubes can be frozen at 20° F. or less and start to melt at 21° F.

Ice containing only potable or fresh water cannot be significantly lowered in temperature after separation from the machine, because at a certain point, the cube will crack and break apart. Furthermore, even if its shelf life is increased, there is no economic reason to place it in special freezers to lower its temperature further. Commercial freezers that maintain a temperature of −20° F. are adequate for the storage of this ice.

Two additional features of the present invention are desirable. It takes double the time and energy to produce salt water ice over fresh water ice. Of course, the water used is cheaper initially. More importantly, ocean and saline water must be decontaminated, and this must be accomplished economically. The process must not purify or desalinate. The use of any process that heats will cause separation, and separation is not desirable. Use of chemicals would be best avoided, for various reasons. Ozone can be produced on site and used to kill both bacteria and viruses, but the energy cost is considerable.

In any case, the ice of the present invention that acts as a freezing agent can be produced at a price that is equivalent to dry ice or less. As with dry ice, it can cause frostbite if not properly handled. It has none of the other dangers of dry ice, for it cannot explode or cause asphyxiation. Thus it is probable that it will not be deemed dangerous and the regulations on shipping of dry ice will not be applicable.

Deeply frozen ice cubes must be produced in a mold that is horizontal to the ground. It can only be produced from liquids that remain motionless within the mold. The lower the temperature of the ice cube, the more difficult it is to separate from the mold. The machine of the present invention has an automatic separation process that is unique, and has allowed for the making of ice at extremely low temperatures.

The original prototype icemaker has one (1) evaporator containing 48 molds. The second model has two evaporators, each with 32 molds. Both machines are about 213.36 cm long, 508 cm wide and approximately 134.62 cm in height. Presently a seven (7 hp) horsepower, air cooled compressor is used. The electric power is 40 AMPS, 208 volts. The power is AC at 60 cycles.

In the method of producing supercooled ice cubes of the present invention, water is poured from above into the molds of the evaporators while horizontal. When ice is produced commercially, the water or desired liquid substance is stored above, and a computer controls the process of liquid injection and removal of the product after discharge from the machines.

To produce the supercooled milk, milk product such as yogurt, water, or beverage ice cubes of the present invention, water in molds is exposed to refrigerant in concave conduits conforming to the shape of the ice cube molds. The coolant is preferably refrigerant 404A fluid, which is regarded as environmentally safe. Flexible water input hoses are used. Flexible refrigerant hoses to the sides of the evaporator are also used. Ice is produced in molds formed as part of the evaporators. Several types of ice can be produced by the same evaporator at the same time. All the ice is removed or separated from the machine at the same time when hot gas is sent through the conduits to melt a thin layer of the surface of the cubes in contact with mold surfaces. Therefore, ice is produced in batches when the evaporator is moved from a horizontal position to a vertical position. It is the direct rapid and uniform application of coolant to the underside and sides of the liquid containing molds, that causes the lower temperature in and about the molds, and the rapid deep-freezing of the cubes.

No hoses are placed under or on top of the trays. The trays are so designed with underlying arcuate forms, preferably crescent shaped evaporator conduits positioned directly under the trays, so that the coolant and or heating fluid contacts the molds uniformly and directly. The underside is rounded so that the refrigerant flows around the underside and sides of the cubes. Thus the cubes produced are rounded on the bottom, no matter the size.

One embodiment for a machine includes flexible molds so that in one batch, several different size cubes can be made. Cubes can be produced in sizes from 60 grams to 2 or more kilograms, according to customer demand. Machines with even larger molds can be constructed, if the market calls for such machines, but this requires more powerful compressors and an increased flow of coolant and hot refrigerant.

The process of separation of the frozen ice cubes from the molds is induced by cycle reversal (similar to a heat pump cycle). Hot refrigerant is directed into the evaporator spaces in the trays for a brief "thaw" cycle, which creates a thin layer of water at the bottom of the cube, thereby dislodging it from the tray when the entire evaporator is automatically and mechanically moved to a vertical position. Thus on separation, the bottom of the cubes feel somewhat wet. The wetness is soon thereafter eliminated by refreezing because the interior of each cube is much below freezing. The ice is produced in full tray batches.

TABLE A

| WATER USE |
|---|
| It takes 1.046 liters of any water used to produce 1 kg of Ice. |

TABLE B

MACHINE PRODUCTION

| | Total Daily Production | Temp. of Cubes | Size of Cubes | Production Time of Batch | Total weight of Batch |
|---|---|---|---|---|---|
| Original Prototype | 522.53 Kg | −28.9° C. | 0.2268 Kg | 30 min. | 10.8862 Kg |
| New tested Prototype | 908.76 Kg | −28.9° C. | 0.2268 Kg | 23 min. | 14.5150 Kg |

The machines of the present invention can produce ice cubes continually. They require no maintenance, except a few hours a year. Because their configuration is essentially open, they are far easier to repair than most icemakers. Those operating the machine will need little training and almost no mechanical ability. The machines waste no water. The machines are made with parts that are readily found in the market place. It is the design and orientation of the icemaker molds, which make them unique.

Both machines can produce a low temperature of −45.6° C. The fresh water ice produced at a temperature of −28.9° C. on separation from the machine has been tested against other wet ice. No other commercial icemaker produces ice at anywhere near this very low temperature.

The standard prior art icemaker produces ice cubes at a temperature of −1.1° C. (30° F.) and the ice cube begins to melt at 0.0° C. (32° F.). The conventional cube size is generally about 25% of the cube size produced by the prototype machines. The smaller the cube the less time it takes to make. The 0.2268 kg cube made with the prototype machines containing pure water lasts five (5) times longer than any ice made with any known icemaker or made from a freezer. How fast ice melts depends on viable factors such as weather conditions, how the ice is stored and so forth.

In appearance it is easy to tell the ice apart. Regular ice, whether it comes in slivers, cubed or blocked is clear. One can see into the ice. Deeply frozen ice cubes of the present invention are white and cloudy in appearance. If the frozen liquid contains impurities, the ice cubes produced take on different colors. For instance, ice made of 100% beer is brownish or tan; ice made of 100% COCA COLA® is bluish.

Supercooled fresh water ice can be produced at a competitive price, although the cube is substantially bigger and lasts far longer. Unlike standard conventional ice, it cannot be made in a home freezer, and a customer cannot make it. Thus if cost is calculated on the basis of usefulness, the ice of this method will cost approximately 20% less than that of standard ice, even though it's actual worth is somewhat more. It is probably less expensive for a customer to purchase this ice than use home made ice.

Seawater contains about 2.7% salt. The amount of salt can vary from time to time and place to place. When producing ice to act as a freezing agent, incorporating a sufficient amount of salt or other impurity is essential. To make a cube of ice containing salt, it must be formed rapidly at a temperature below at least about −17.8° C. Ice can be formed from ocean or saline water at a temperature somewhat lower than −6.1° C.

Using normal icemakers to form cubes from saline or seawater, the water molecules have time to separate all or most of the salt and other impurities because of the time it takes to form ice. This is called the slow freeze process, and has been tested in Canada and the United States to desalinate and purify saline water. There are icemakers, that can use seawater to make ice, but the salt and other minerals separate out, because the process is slow. They can make no more than slivers of ice containing salt and other impurities, and absent the salt, the ice cannot be used to freeze or maintain the frozen state.

Up to now salt water containing cubes have only been made in laboratories, usually with nitrogen or other fast processes similar to the freezing of food.

To make ice, the icemaker must reach a temperature well below the freezing point of sea or saline water quickly enough to trap the salt. Few icemakers can freeze ocean or saline water using any method.

Salt water ice, when it starts to melt at −6.1° C., the salt content begins to separate and the cube begins to weaken before it melts away. Ultimately it will break upon touch. The literature states that the advantage of the salt containing cubes is that the temperature can be lowered far more than ice cubes containing only fresh water. Fresh water cubes will crack at a low enough temperature. The salt in a salt containing cube (and possibly other impurities) acts as a binder. Based on available literature such cubes can be lowered to almost absolute zero and still maintain the configuration unlike fresh water ice cubes. If the literature is correct, it is probable that the shelf life of salt water ice can be substantially increased well beyond that of dry ice. To accomplish this requires special freezers. The value of this ice could be more than doubled. Tests were conducted with the salt water ice cube placed in a special freezer that dropped the temperature to only −80° C. At that temperature, the shelf life was found to be equal to or slightly superior to dry ice of the best quality.

Although salt containing cubes can be produced at about −28.9° C., it is preferably produced at about −45.6° C. It is expected that this ice entails greater handling (greater care must be used) and increased production costs over regular ice of about 10 cents per kilogram. The production cost per kilogram of fresh water ice in the New York area (absent taxes and delivery) is about 8 cents per kilogram. Thus the production cost of salt water ice is about 18 cents per kilogram. Salt water ice can be sold for less than $1.00 per kilogram. Despite its shorter shelf life (which may not be significant), customers might want salt water over dry ice, for its other advantages. In the New York area, the lowest price found for mediocre dry ice was $1.32 per kilogram as of the summer of 2002.

TABLE C

A COMPARISON OF FRESH WATER, SALT WATER AND DRY ICE

| Product | Fresh Water Ice | Other Fresh Water Ice | Salt Water Ice | Dry Ice |
|---|---|---|---|---|
| Ice Temperature As Produced [] | −28.9° C. | −1.1° C. | −45.6° C. | −78.5° C. |
| Starts to melt (at standard atmospheric pressure) | 0° C. | 0° C. | −6.1° C. | Does not melt sublimates (goes from a solid to gas at a rate of 2.2680 kg every 24 hours in a typical ice chest.) |
| Cost per Kg in New York City 2002 (without delivery) | 20 cents | 15 cents and up | Approx. $1.00 | $1.32 to $2.20 |
| Content of Final Products | Fresh Water | Fresh Water | Water, Salt, minerals | $CO_2$ |

In contrast to salt water ice of the present invention, a pound of conventional dry ice will sublimate (change from a solid into a gas) of 8.3 cubic ft of $CO^2$. It sublimates at 10%, or between 5 to 10 pounds every 24 hours, whichever is greater. Thus the more dry ice, that is in a container, the longer it lasts. As it sublimates, it absorbs heat and expands to 800 times its original volume. If not properly vented, this expansion could cause an explosion. As it sublimates, the carbon dioxide replaces oxygen in the surrounding area. The replacing of oxygen could pose some danger, when the area is not properly vented.

Approximately 2.2680 kgs of dry ice of good quality, in the best package available, containing 9.0719 kgs of frozen foods, will fully sublimate (change to a gas), within four hours, and the frozen food will start to defrost. Spoilage may follow. Dry Ice of the same weight will last longer in smaller containers of equal quality having reduced amounts of frozen food, but not longer than a day.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
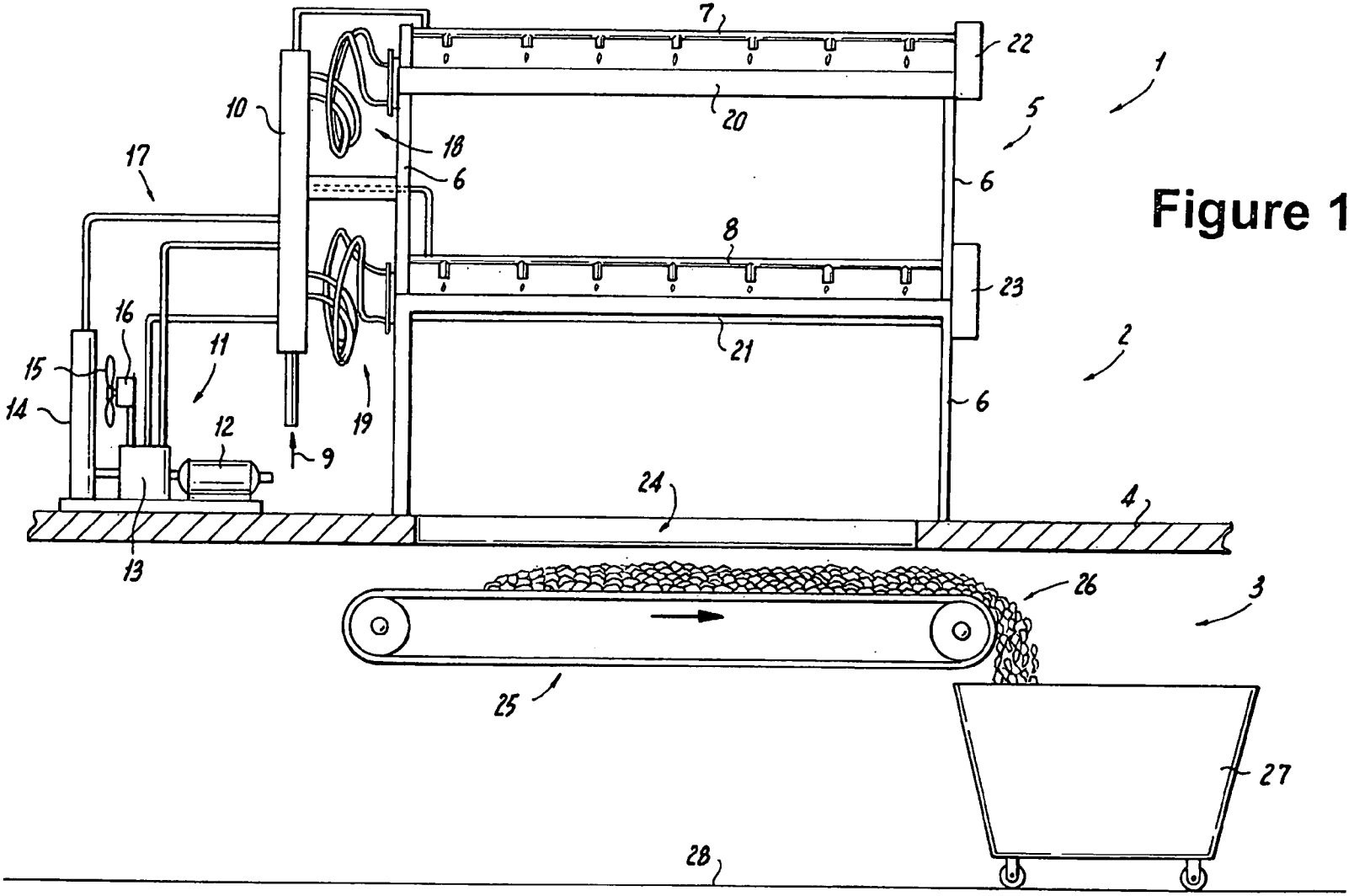
FIG. 1 is a Side elevation view of an ice making system of this invention.

FIG. 1 presents an illustration of an embodiment of this invention as a complete ice making system 1 housed on an upper floor 2 and a lower floor 3 of a building. The ice making apparatus 5 rests on support floor 4, which has a large opening communicating with the floor 3 below. Under this opening is conveyor belt 25 which moves dumped ice segments 26 to bin 27 which rests on the lower floor surface 28. A vapor compression refrigeration system 11 (part of ice making apparatus 5) includes compressor motor 12, compressor 13, fan motor 16, fan 15, heat exchanger 14, and rigid refrigerant lines 17.

Frame 6 supports a horizontally oriented lower ice tray 21 with rotator housing 23 and a horizontally oriented upper ice tray 20 with its rotator housing 22. Control housing 10 is also attached to frame 6.

Flexible refrigerant hoses 18 connect upper tray 20 to housing 10, while corresponding hoses 19 connect to lower ice tray 21. Fixed housings for the two looped hose bundles 18 and 19 have been removed for this illustration.

Prechilled water at just above the freezing point enters at 9 and is distributed by manifold and drip tubes 7 to upper horizontal tray 20 while manifold and drip tubes 8 serve the same function for lower horizontal tray 21.

Besides fresh water, milk, milk products such as yogurt, and salt water can enter at input 9, as can juice and sweetened beverages, such as beer, wine or soda beverages.

While dual horizontal ice trays are shown in this embodiment, an ice-making machine with only one horizontal freezing tray or with as many as three stacked horizontal freezing trays may be configured to serve the desired capacity. A single ice tray system will be described in the following detailed discussion. Implementation on two separate floors of a building as illustrated is also not required; a conveyor can be placed within frame 6 on a single floor of a building. The prechilled water from which ice is made can be supplied by a separate chiller or by a heat exchanger on the evaporator line.

Figure 2:
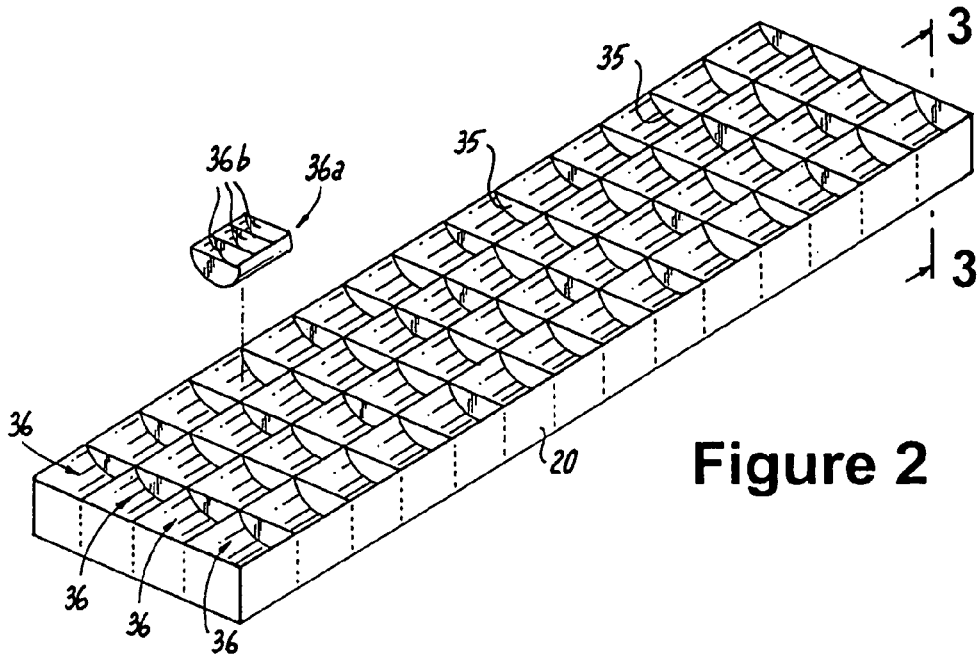
FIG. 2 is a Perspective view of an ice tray of this invention.

FIG. 2 shows horizontally oriented ice tray 20, which includes one or more attached troughs 36, such as four, with ice segment separators 35. The distance between separators 35 can be varied by placement of spacers 36*a* conforming to the same overall shape as compartments 36, but with smaller sub-compartments 36*b* therein. These spacers 36*a* are of a non-stick, non-metallic material, such as plastic or Teflon. For example, while FIG. 2 shows separators 35 forming spaces 36 of a square configuration, separators 35 can be farther apart from each other, to form elongated compartments, which can be broken up incrementally into smaller compartments by insertion of non-metallic spacers 36*a* therein.

Figure 3:
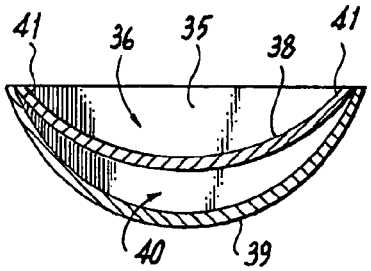
FIG. 3 is a Crossection view of an ice tray channel.

FIG. 3 is a cross-section of a trough 36 showing inner ice forming surface 38 which is circular attached at edges 41 to outer layer 39 which is also circular, but of a smaller radius. This construction creates an enclosed space 40 through which refrigerant is conducted. The material for the trough can be copper which is brazed at edges 41 and then nickel-plated. Other materials of high heat conductivity can be used as well. Welded stainless steel construction can be used for making brine ice for low temperature applications.

It is understood that water resting on surface 38 would freeze if liquid refrigerant is permitted to evaporate within space 40; similarly, hot refrigerant vapors in space 40 would tend to condense melting ice in contact with surface 38. Ice segment separators 35 are similarly attached as by brazing or welding; they are made of the same material as the two layers of the trough.

Figure 3A:
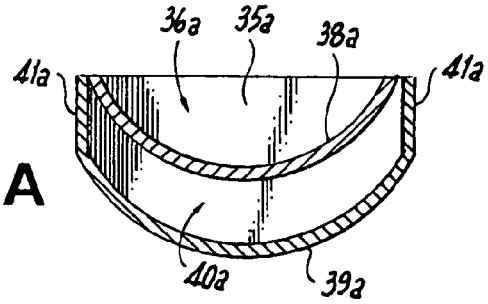
FIG. 3A is a Crossection view of an alternate embodiment for an ice tray channel.

In the alternate embodiment shown in FIG. 3A, trough 36*a* has inner ice forming arcuate surface 38*a*, which is attached by vertically extending spacers 41*a* to outer layer 39*a*, which is also arcuate of the same diameter and therefore parallel to inner ice forming arcuate surface 38*a*, to form enclosed space 40*a* therebetween. The benefit of the configuration shown in FIG. 3A is that an equal amount of liquid refrigerant or alternatively hot refrigerant vapors flows at the edges near spacers 41*a*, as flows in the center of enclosed space 40*a*, thereby reducing flow stagnation for more even heat transfer at surface 38*a*. In FIG. 3A, outer arcuate layer 39*a* has the same length as inner ice forming arcuate surface 38*b*, which minimizes loss of heat or cold through outer arcuate layer 39*a* and minimizes space loss between adjacent channel troughs of ice tray 20.

Figure 3B:
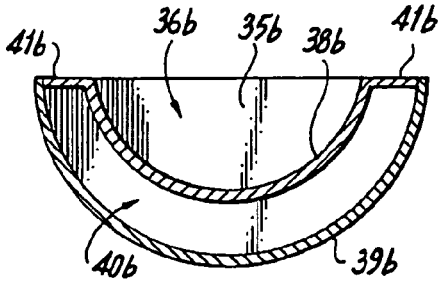
FIG. 3B is a Crossection view of a further alternate embodiment for an ice tray channel.

In the further alternate embodiment of FIG. 3B, trough 36*b* has inner ice forming arcuate surface 38*b*, which is attached by spacers 41*b*, which extend between inner arcuate surface 38*b* and outer layer 39*b* in a different orientation, such as being horizontally extending. Outer layer 39*b* is also arcuate of the same diameter and therefore parallel to inner ice forming arcuate surface 38*b*, to form enclosed space 40*b* there between. The benefit of the configuration shown in FIG. 3B is also that an equal amount of liquid refrigerant or alternatively hot refrigerant vapors flows at the edges near spacers 41*b*, as flows in the center of enclosed space 40*b*, thereby also reducing flow stagnation for more even heat transfer at surface 38*b*.

Figure 4:
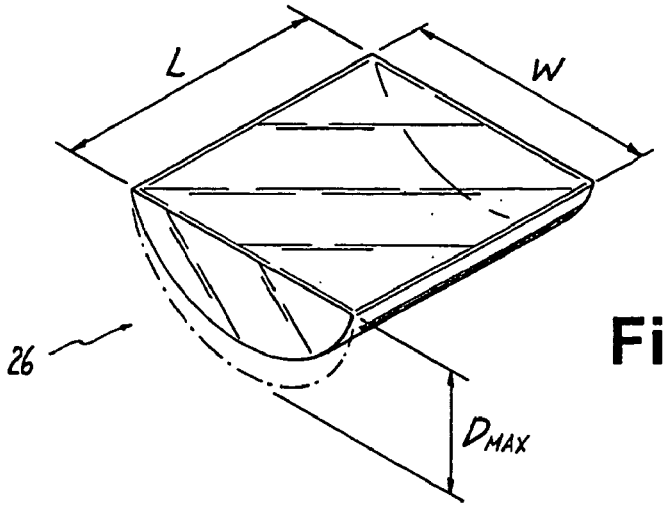
FIG. 4 is a Perspective view of an ice segment as produced by the apparatus of this invention.

FIG. 4 shows ice segment 26 with width W, length L and depth D. The maximum depth, $D_{max}$, would be W/2 thereby making the end contour into a semicircle. It has been found that a shallower configuration dumps easier (shorter cycle time). Length L can be much longer than W if desired for some applications; this is regulated by the placement of spacers 35.

Figure 5:
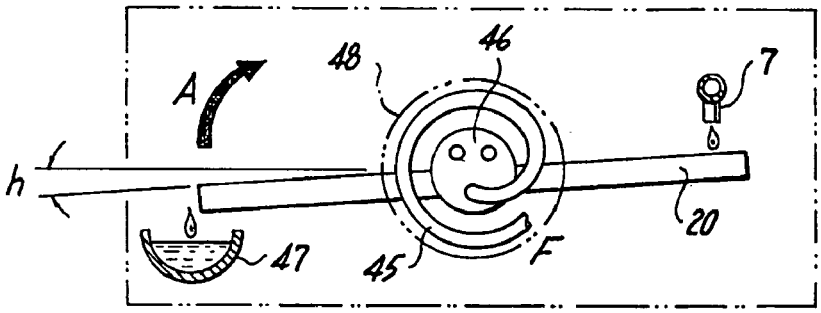
FIG. 5 is an End view of freezing tray in the fill/freezing position.
Figure 6:
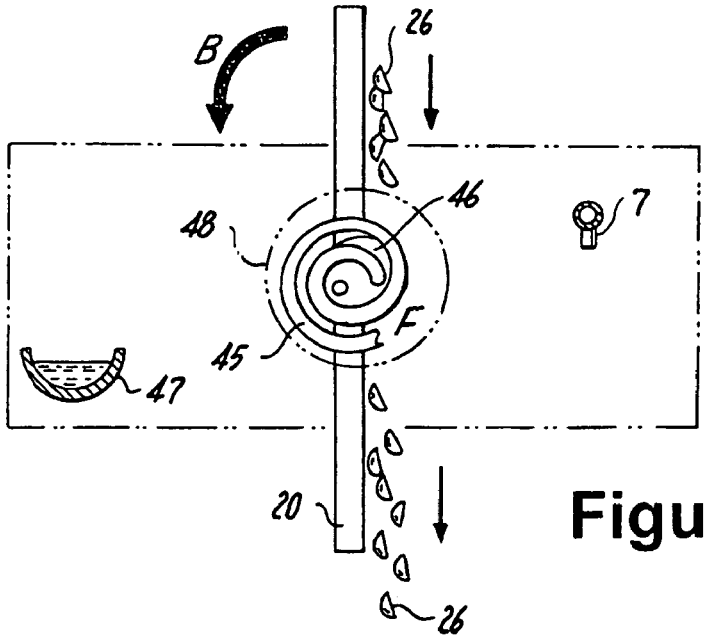
FIG. 6 is an End view of freezing tray in the ice cube dump position.

FIGS. 5 and 6 show two positions of ice tray 20. In FIG. 5, it is in a slightly tilted position from horizontal (angle "h") to facilitate filling from drip tubes 7 with any overflow of chilled water captured and returned in trough 47. After the filling period, the water in horizontal tray 20 is frozen while in this position.

Typically, 3 hoses are attached to each horizontal tray 20, two smaller evaporator hoses (approximately ⅜" diameter) and a suction hose (about ½" diameter). These types of hoses are currently used to carry refrigerant in truck-mounted units. In this figure only the vapor hose 45 is shown so as to more clearly illustrate the spiral shape of the flexible connection from tray hose plate 46 to fixed attachment end at "F". Housing 48 would occupy the outline as shown.

After the ice is formed, horizontally oriented tray 20 is rotated clockwise (A) into the vertical position shown in FIG. 6. Note that the spiral of hose 45 is now tighter. When "thaw" heating is applied while in this position, ice segments 26 are dumped from tray 20. After the dumping cycle is complete, tray 20 is rotated counterclockwise (B) back to the horizontal position for the next ice making cycle.

Figure 7:
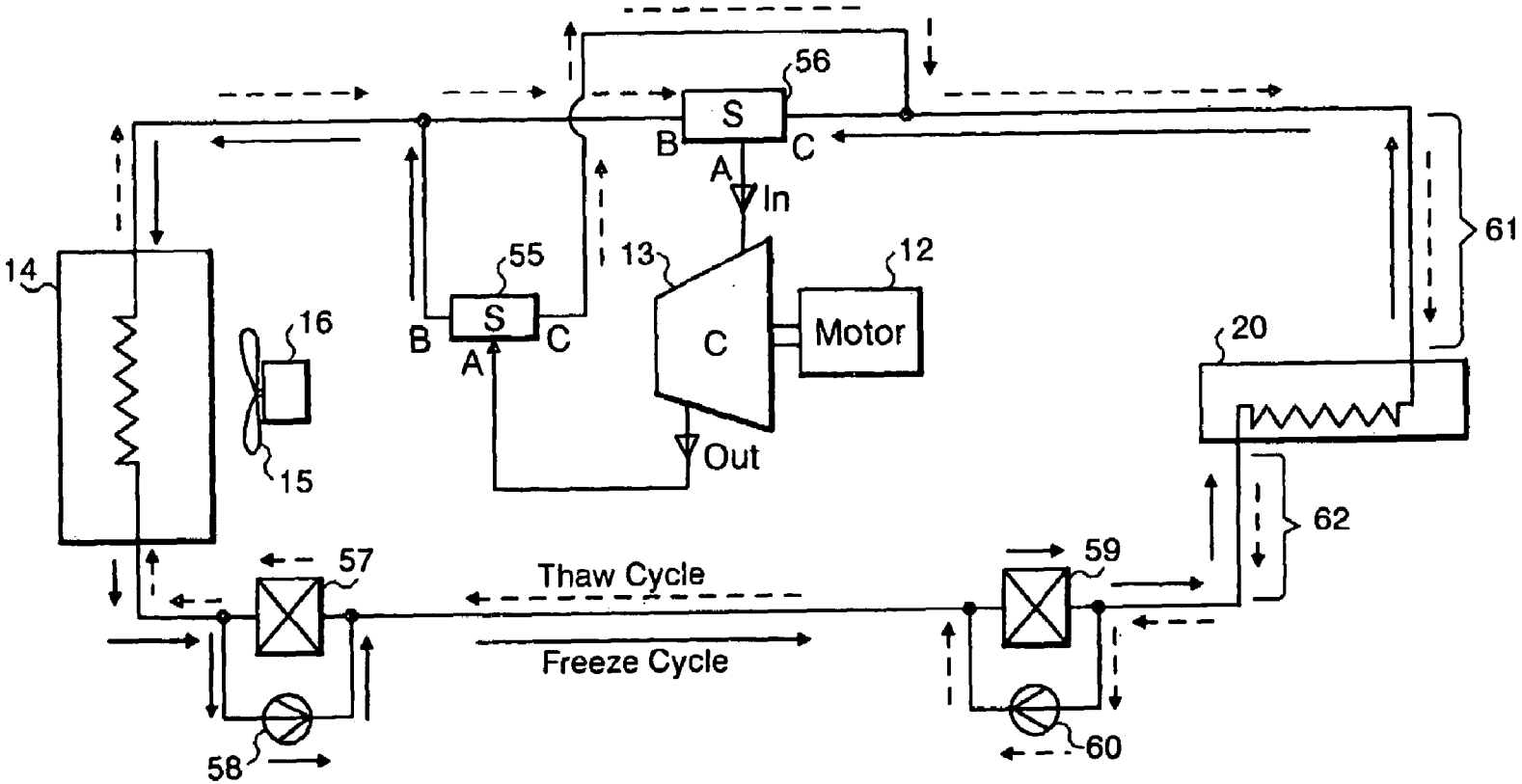
FIG. 7 is a Plumbing schematic of this invention showing fluid paths for both freezing and "thaw" cycles.

Both the ice making (freezing) cycle as well as the thaw cycle flow are shown on the flow schematic of FIG. 7. In addition to components already mentioned, expansion/throttle valve 57 with bypass check valve 58—expansion/throttle valve 59 with bypass check valve 60, as well as 3-port solenoid valves 55 and 56 are shown.

In the freeze cycle (shown by solid arrow shafts), liquid refrigerant flows through expansion valve 59 into ice tray 20 where it evaporates by extracting heat from ice water thereby freezing it. Suction is drawn from horizontal tray 20 by a path from orifice "C" to orifice "A" of solenoid 56 to the input of compressor 13. Refrigerant vapors are compressed and emerge from compressor 13 as hot vapors through orifice "A" to orifice "B" of solenoid 55 and onward to heat exchanger 14 which is now acting as a condenser with liquid refrigerant flowing through check valve 58 to complete the cycle.

For the thaw cycle (shown by dashed arrow shafts), liquid refrigerant flows through expansion valve 57 into heat exchanger 14 which now acts as an evaporator extracting heat from environmental air to vaporize refrigerant. Suction is drawn from heat exchanger 14 by a path from orifice "B" to orifice "A" of solenoid 56 to the input of compressor 13. Compressed hot vapors emerge from compressor 13 through orifice "A" to orifice "C" of solenoid 55 and onward to ice tray 20 which now acts as a condenser giving up heat to melt a surface of ice segments whereby refrigerant is condensed to a liquid which flows through check valve 60 to complete the cycle. Note that segments of piping 61 and 62 denote flexible hoses.

Figure 7B:
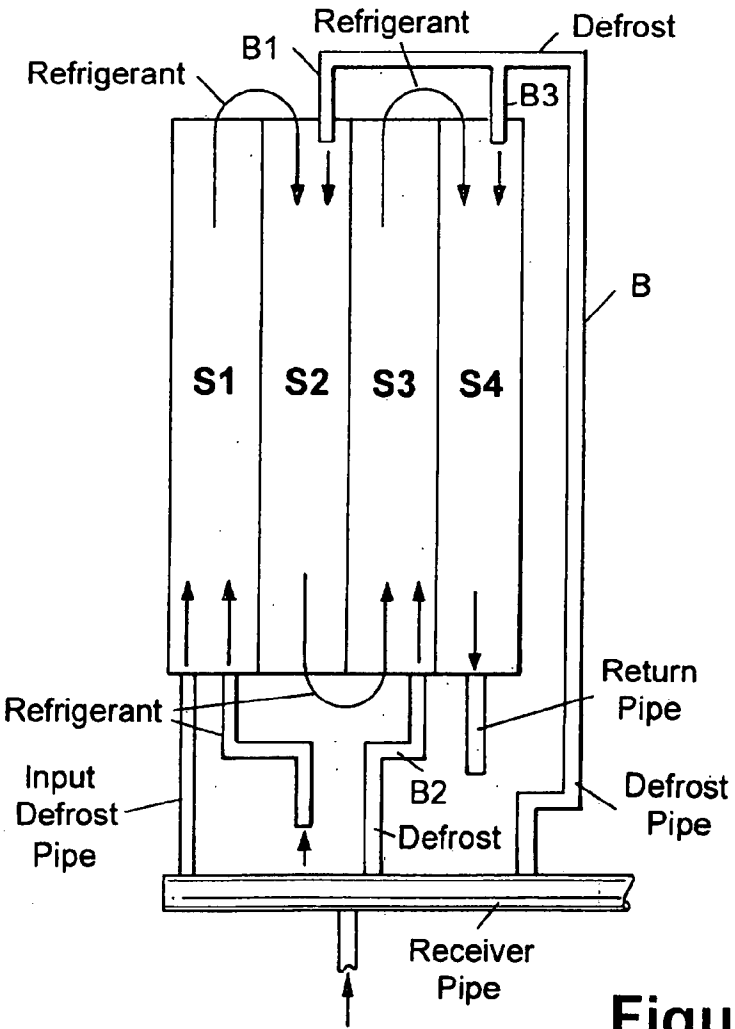
FIGS. 7A and 7B show alternate flow diagrams for refrigerant flow through the fluid paths.
Figure 7A:
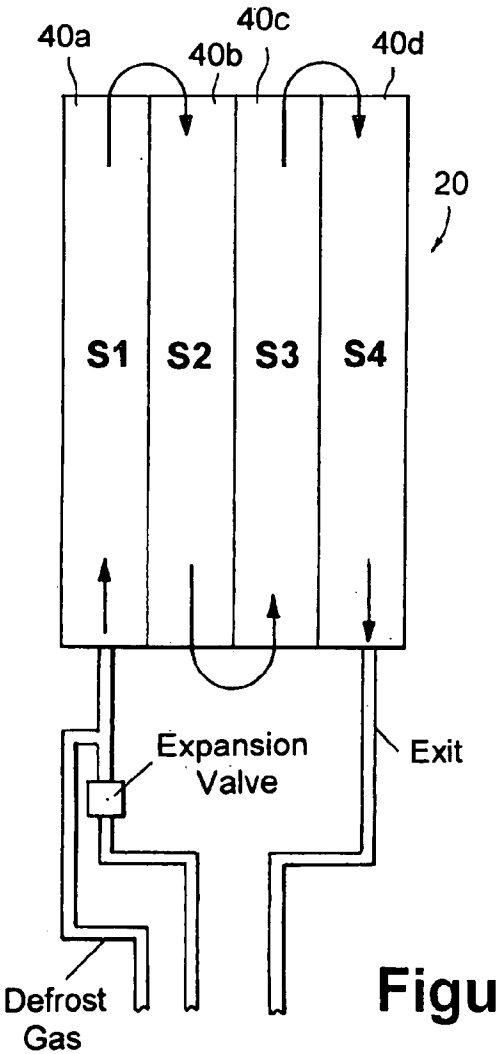

FIGS. 7A and 7B show alternate embodiments for flow of liquid refrigerant through hollow arcuate enclosed pipe spaces 40 or 40*a* of ice tray 20. In FIG. 7A, fluid flows of refrigerant enter an expansion valve before entering enclosed pipe spaces 40, 40*a* or 40*b* of ice tray 20 for the freezing cycle, before the fluid flows are alternated for the defrost gas cycle. In FIG. 7A, however, fluid flows alternately through adjacent enclosed pipe spaces corresponding to fluid flow paths S1, S2, S3 and S4. However, as the defrost gas passes through the extended lengths of flow paths S1, S2, S3 and S4 of enclosed pipe spaces 40, 40*a* or 40*b*, the hot defrost gases cool down, so that they are not as hot when they exit enclosed pipe space indicated by fluid flow path S4 at the exit return pipe.

An even more efficient flow occurs in the flow configuration of FIG. 7B, where refrigerant enters an enclosed pipe space corresponding to fluid flow path S1. The refrigerant flows thence to adjacent enclosed pipe spaces indicated by fluid flow paths S2, S3 and S4, before exiting at a return pipe. In the defrost cycle, hot defrost gas enters from a receiver pipe to defrost input pipe into the enclosed pipe space corresponding to fluid flow path S1. However, as the hot defrost gas fluid flows from the enclosed pipe space corresponding to fluid flow path S1 into the enclosed pipe space corresponding to fluid flow path S2, further hot defrost gas enters through from defrost bypass pipe B to further bypass pipe B1 to augment defrost gas flow entering the enclosed pipe space corresponding to fluid flow path S2. In addition, as hot defrost gas passes from the enclosed pipe space corresponding to fluid flow path S2 into the enclosed pipe space corresponding to fluid flow path S3, it is augmented by further hot defrost gas from bypass pipe B2. Likewise, as defrost gas exist from the pipe space corresponding to fluid flow path S3, it is also augmented by fresh, hot defrost gas entering from bypass pipe B3. This maintains equilibrium in defrosting, so that as the original hot defrost gas passes through the enclosed spaces corresponding to fluid flow paths S1, S2, S3 and S4, and is cooled by exposure to ice in the mold compartments of the troughs above the enclosed pipe spaces, it is reheated by the fresh defrost gas being entered through bypass pipes B1, B2 and B3. In that manner, although the defrosting fluid vapors lose some of their effectively by being cooled by exposure to the ice being defrosted, they are augmented by this auxiliary hot gas defrost flow. This also causes even separation of the ice from tray 20, and at a considerably faster defrost time.

Certain controls and electrical wiring are required to support the activity described in FIG. 7.

Figure 8:
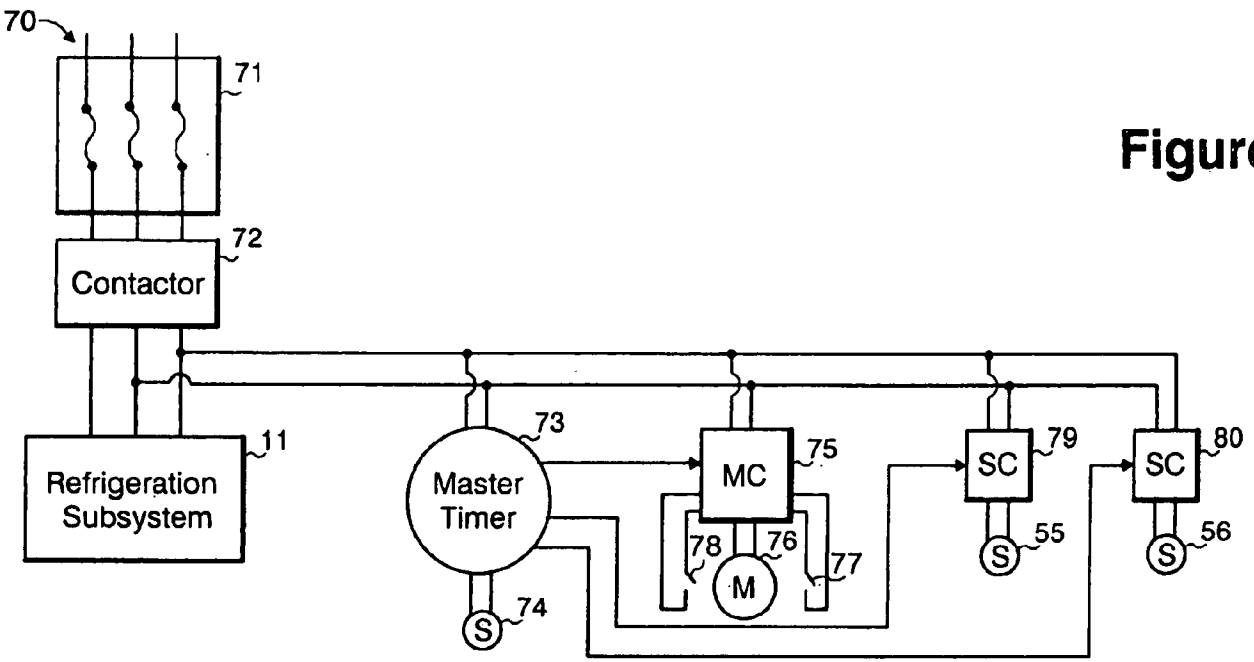
FIG. 8 is an Electrical block diagram of this invention.

For example, FIG. 8 is an electrical block diagram which describes the functioning of this invention. Either three phase AC or single-phase 3-wire utility electricity enters at 70. Utility box 71 contains protection fuses. Contactor 72 applies power the entire ice making system including refrigeration subsystem 11. A master timer 73 controls the timing of the various components; solenoid 74 which controls the filling of ice tray 20 is directly controlled. Motor controller 75 gets its timing cue from master timer 73 to initiate the operation of motor 76 which changes the position of tray 20 form one position to the alternate position. Limit switch 78 stops motor 76 when tray 20 has reached the fill position; limit switch 77 stops motor 76 when tray 20 has reached the vertical position. Solenoid controllers 79 and 80 control solenoids 55 and 56 respectively upon cues from master timer 73. While illustrated as an open-loop control, timer 73 can be enhanced with feedback sensors such as temperature and/or refrigerant pressure sensors; however, since operating conditions should be quite invariant once initially set up, this refinement may not significantly improve efficiency and can contribute to unreliable operation.

Figure 9:
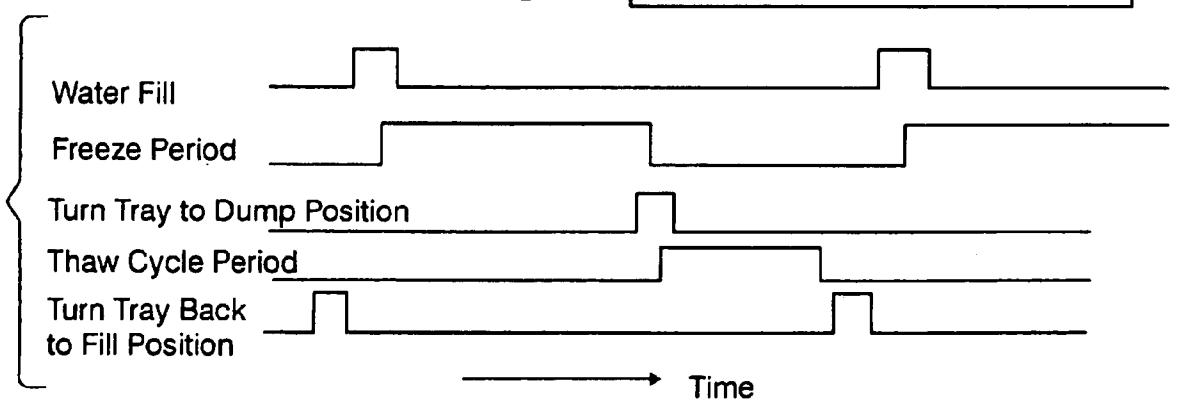
FIG. 9 is a Timing diagram of ice making cycle of this invention.

FIG. 9 shows a timing diagram of the various operations. The timing relationships, durations, and overlap can be seen for a typical installation. A total cycle time for making an ice batch of ten minutes is achievable with proper matching of the various parameters. This would be illustrated by the chart distance from the start of a "water fill" pulse to the next. Water filling, freeze periods, dump turning, thaw periods, and fill turning are illustrated in the timing diagram.

FIGS. 10, 11, 12 and 13 show alternate embodiments with respect to the horizontal orientation of the freezing tray.

Figure 10:
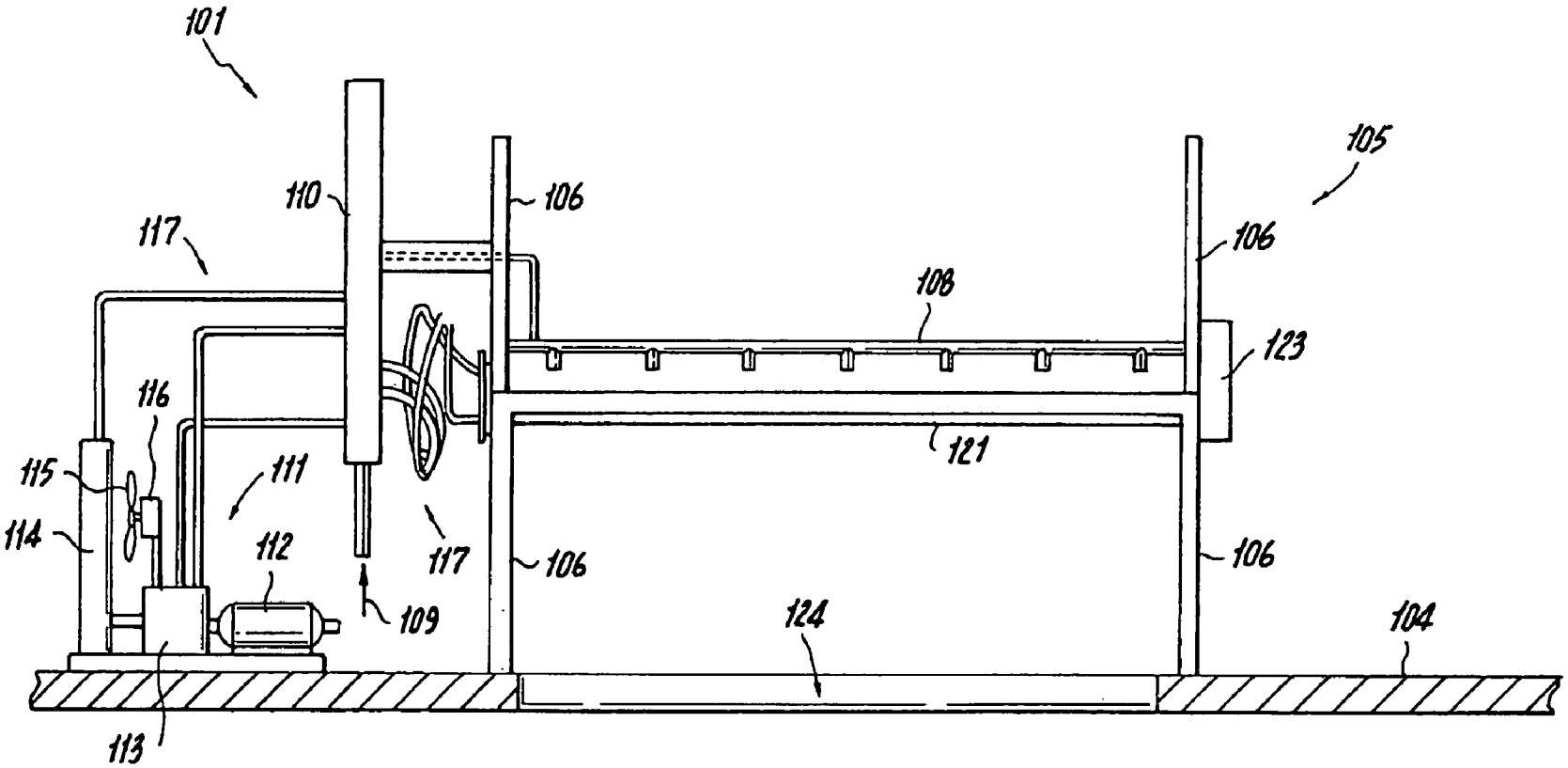
FIG. 10 is a Side elevation view of an alternate embodiment for an ice making system having a countertop display and a removable water inlet source, shown in the water introduction phase.
Figure 11:
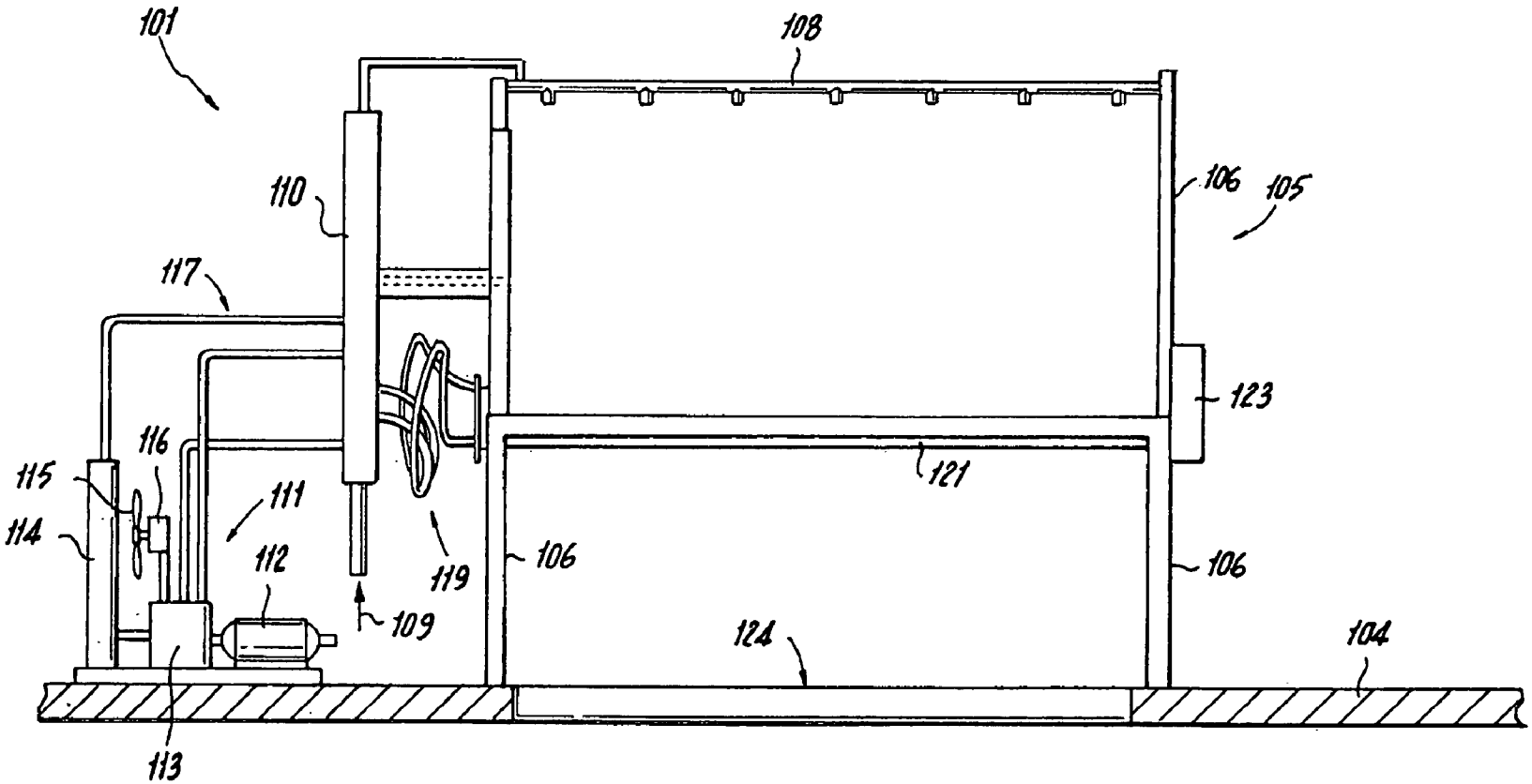
FIG. 11 is a Side elevation view of the alternate embodiment as in FIG. 10 for an ice making system having a countertop display, with the water inlet source shown removed upward away from the countertop display.
Figure 12:
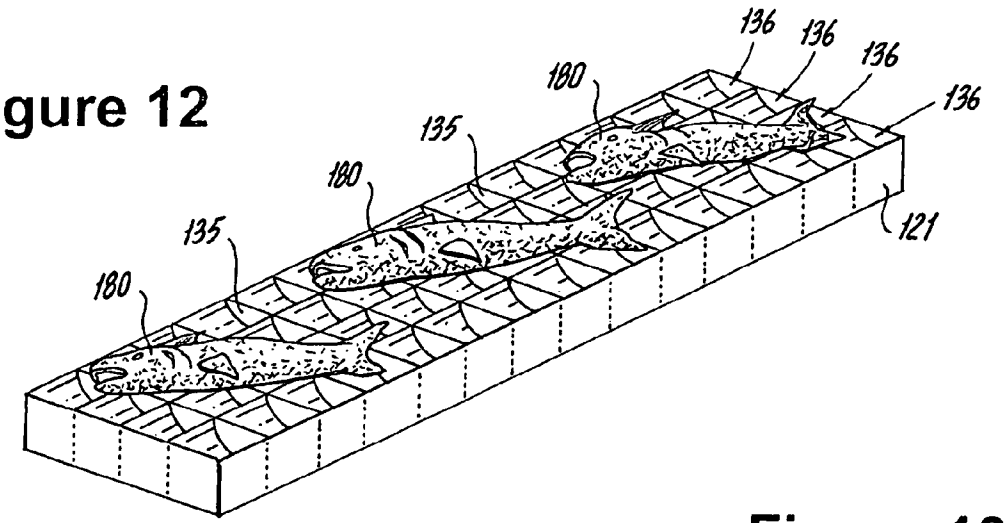
FIG. 12 is a Perspective view of the countertop freezing tray portion of the embodiment of FIGS. 10 and 11, shown with fish displayed thereon.

In FIGS. 10 and 11, inlet drip tubes 108 are shown close to freezing tray 121 for introducing water, and then inlet drip tubes 108 lifted out of the way as in FIG. 11, so that tray 121 can be used as a counter-top for displaying fish for sale at a fish store, as shown in FIG. 12.

FIGS. 10–12 presents an illustration of an embodiment of this invention as a countertop display ice-making system 101. The ice making apparatus 105 rests on support floor 104 which has an optional drain opening 124 communicating with the floor 104. A vapor compression refrigeration system 111 (part of ice making apparatus 105) includes compressor motor 112, compressor 113, fan motor 116, fan 115, heat exchanger 114, and rigid refrigerant lines 117.

Frame 106 supports a liftable or removable horizontally oriented ice tray 121 with lift mechanism 123. Control housing 110 is also attached to frame 106.

Flexible refrigerant hoses 119 connect horizontal countertop tray 121 to housing 110.

Prechilled water at just above the freezing point enters at inlet 109 and is distributed by manifold and drip tubes 108 to horizontal countertop freezing tray 121. While liftable horizontal countertop ice tray 121 is shown in this embodiment, an ice-making machine with a removable or horizontally shiftable horizontal countertop freezing tray or trays 121 may be configured to serve the desired capacity. The prechilled water from which ice is made can be supplied by a separate chiller or by a heat exchanger on the evaporator line.

FIG. 12 shows horizontally oriented countertop ice tray 121 displaying fish 180 thereon. Tray 121 includes one or more attached troughs 136, such as four, with ice segment separators 135.

Figure 13:
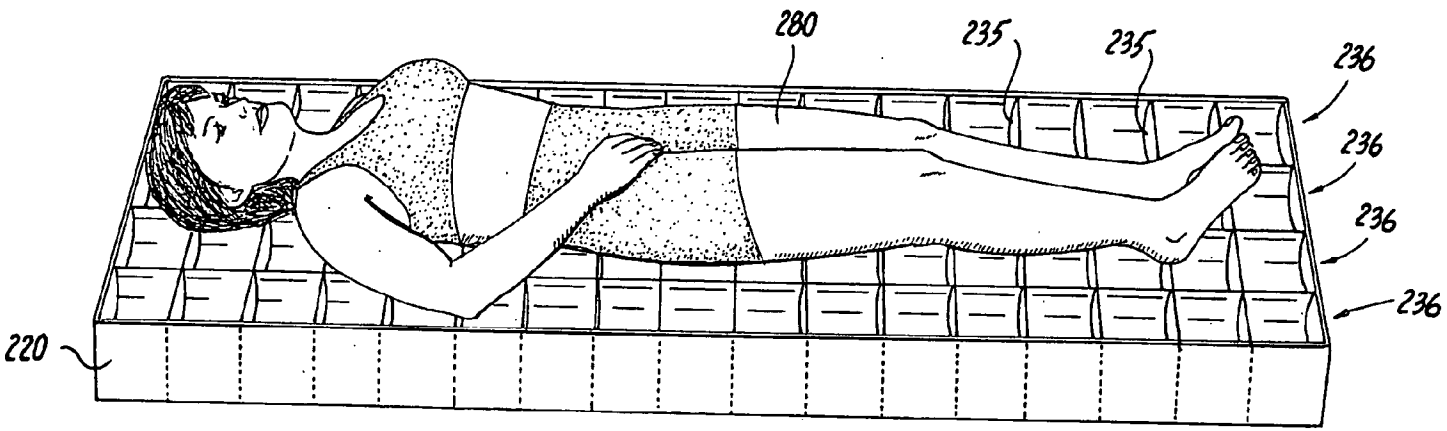
FIG. 13 is a Perspective view of an alternate embodiment for an ice tray functioning as a physical therapy bed, shown with a user lying thereon.

FIG. 13 shows an even further alternate embodiment where the horizontal freezing tray 220 is used as a physical therapy bed device for a human patient 280 with a need for ice application to the back, neck or limbs. FIG. 13 shows corresponding attached troughs 236 with ice segment separators 235. It is anticipated for user comfort that the tops of troughs 236 and separators 235 are covered with a soft elastomeric material, such as rubber or synthetic materials such as polyurethane foam.

Furthermore, in the embodiments of FIGS. 10–13 where the ice can remain in place and does not have to be dumped until melted after use as a display countertop or physical therapy bed, then the introduction of hot gas in the curved hollow sleeves under respective ice segment compartments 136 or 236 can be optional if the ice formed just stays in place until melted, such as in a fish display or in the physical therapy bed embodiment. In that case one would only need the refrigerant to flow through hollow arcuate sleeves similar to hollow arcuate sleeves 40 in FIGS. 1–3 herein, to freeze the water in horizontal countertop tray 121 of FIG. 12 or physical therapy bed 221 of FIG. 13.

Therefore, the method of producing salt containing segments of ice in which the salt is substantially uniformly distributed throughout the ice segments includes the steps of:

a) pouring water containing salt into a horizontal mold divided into separate ice forming compartments;
b) chilling said mold while in a horizontal position at a sufficient rate of cooling to prevent desalination of the water in said mold and produce a single solid segment of ice in each compartment; and
c) continuing said chilling until the temperature of the ice in said mold is between minus 10° F. and minus 50° F. thereby producing supercooled segments of ice.

The segments of ice are removed by rapidly subjecting said supercooled ice segments to a short, temporary contact with a high heat source to melt a thin layer of ice adjacent walls of said mold and rotating said mold to a substantially vertically oriented dump position whereby said segments of ice are dumped from said mold into a collection bin.

The salt water can be fresh water with salt added or seawater. Typically, the water contains salt in the amount of about 3% by weight. If the salt percentage is increased, the temperature of the ice cube thus formed, is lower than if the salt percentage is about 3% by weight.

Chilling of the salt water to about minus 40 degrees F. is preferably done at the rate of about twenty to thirty minutes time duration.

The ice cube containing mold is tipped slightly during filling to discharge excess water into a trough, with the mold being righted back into a horizontal position after said compartments are filled with salt water for freezing.

Preferably the ice cube forming mold includes a conduit with an upper curved wall extending the length of the mold forming an upwardly facing concave surface divided into ice cube compartments, by a plurality of spaced separators and a lower curved wall forming an arcuate, preferably crescent shaped passageway through the length of the mold, with the upper and lower curved walls being joined at parallel edge walls or edges thereof.

Figure 14:
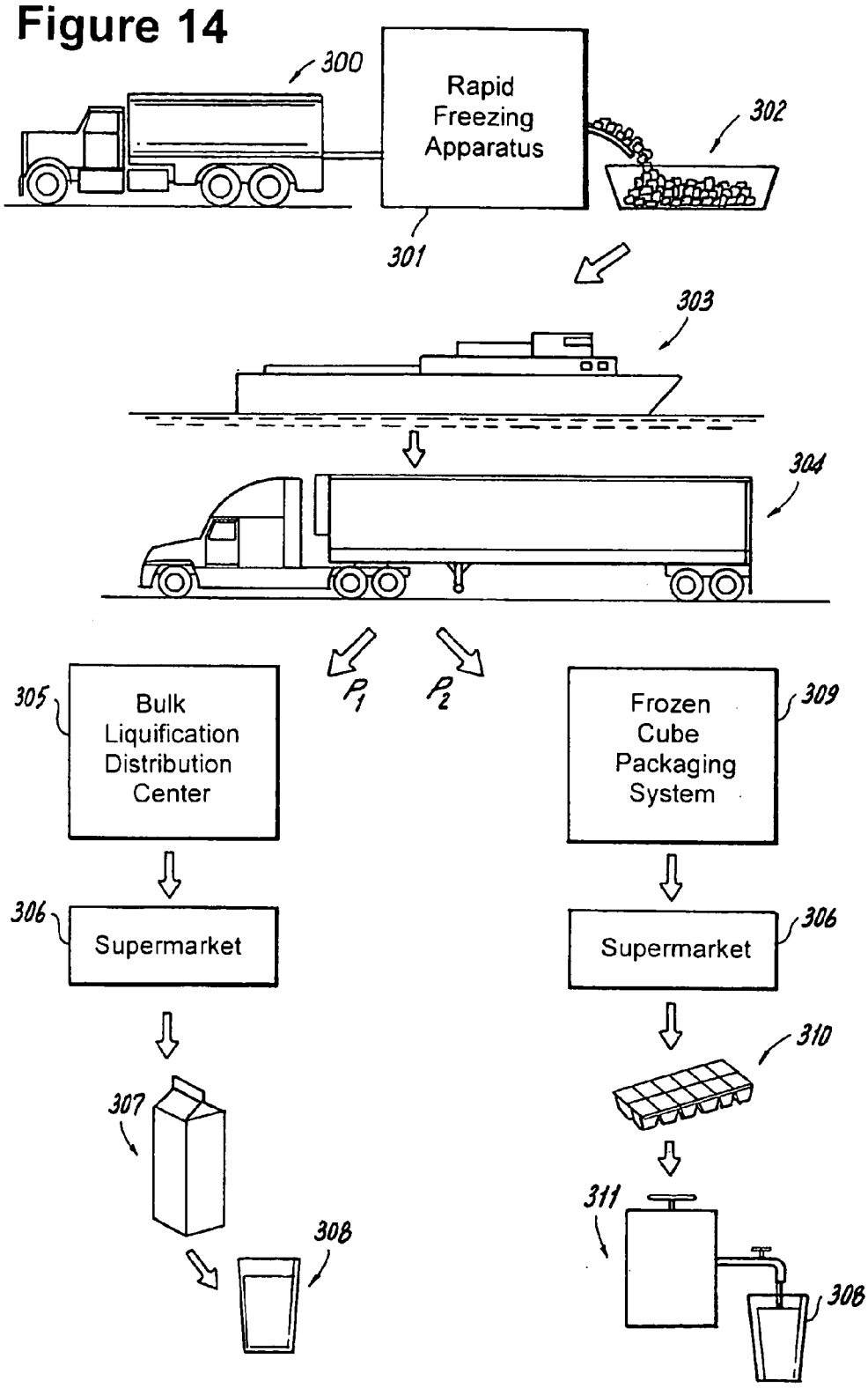
FIG. 14 is a pictorial process flow diagram for a further embodiment for distribution of frozen milk or similar products; and, FIG. 15 is a schematic side view of a rapid liquefier, used with the embodiment of FIG. 14.

This invention can be used to form ice cubes from such different beverages as fruit juices with pulp as well as all varieties of milk (without the need for added emulsifiers or enzymes, and without condensing, drying, or concentrating the milk) and milk products such as yogurt. This is possible due to the rapid freezing process and low temperatures used. Once in ice form, the constituent parts of the beverage are immobilized and need not be kept at a super cooled temperature for storage; normal freezer temperature should suffice. Since the product, such as milk, is needed in a liquid form by the end user, the cubes are melted at some point in the distribution process prior to use. A rapid liquefier device of appropriate size is preferably used to accomplish this step. The process for providing liquid milk (or other beverage) for the consumer using the apparatus of this invention is illustrated in FIG. 14. First, liquid beverage (milk) 300 is pumped into the rapid freezing apparatus 301 of this invention creating milk ice cubes 302. These super-cooled cubes are bulk shipped 303 even long distances to trucks 304, which can take one of two paths. Path P1 leads to a bulk liquefaction and packaging distribution center 305 where large bulk rapid liquefiers are used to convert the milk cubes to a liquid, which is then packaged in bottles or containers; the milk cubes can also be stored in freezers if there is no immediate demand. Liquid milk is then shipped to a supermarket 306 where it can be bought by a consumer in bottles 307 and then stored in a home refrigerator or poured into a glass 308.

The alternate truck 304 path, P2, takes the milk cubes to a frozen cube packaging center 309 where the cubes are packaged into convenient "break-away" consumer sized packages. These are shipped to supermarket 306 where a consumer can purchase container 310 and either store it in the home freezer or break off the desired number of cubes to instantly liquefy in home liquefier 311 to pour milk into glass 308. Note that the cubes 302 for path P2 would be smaller than the cubes 302 used by a commercial rapid liquefier as in path P1.

Figure 15:
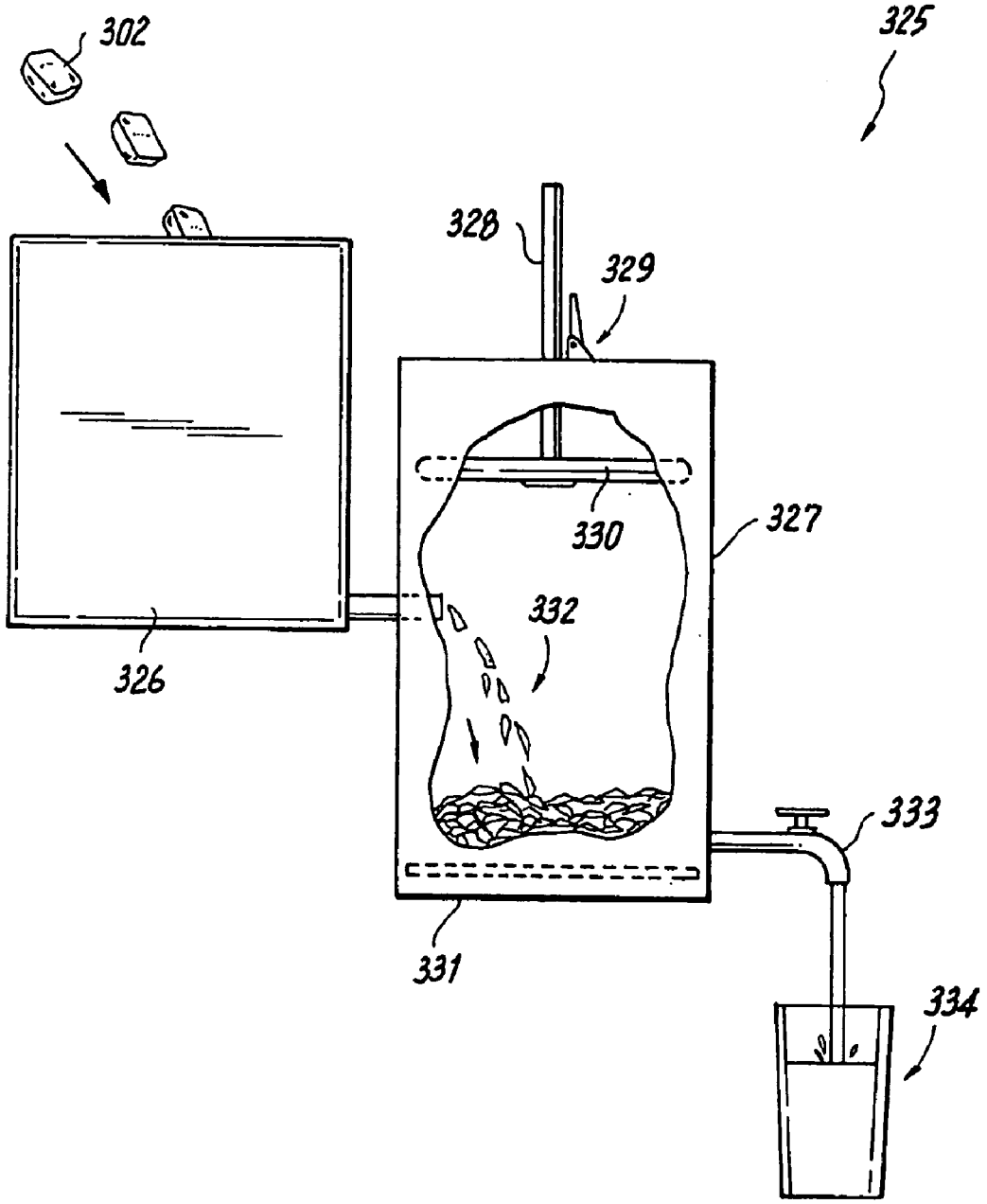

FIG. 15 is a schematic diagram of a rapid liquefier 325. It can be scaled to industrial proportions, or sized as a home appliance. It consists of an ice shaver 326 into which milk or beverage cubes 302 are dumped; this is attached to a liquefier section 327. Ice shavers 326 are a well-known apparatus; for a home liquefier, a model similar to the Rival model IS450-WB Deluxe Ice Shaver can be used. Liquefier section 327 has a heating element embedded in its bottom 331. It receives ice shavings 332. When the shaving process is over, weighted plunger 330 (preferably with embedded heating element) is released by latch 329 so that guidance rod 328 is freed to guide plunger 330 to compress shavings 332 to accelerate melting of shavings 332. Liquid thus produced is guided via spigot 333 to receiving container 334. Especially for a home unit, it may be desirable to have a variety of temperature settings for the heating elements so that the liquid produced is either very cold, or any other temperature to hot. For example, hot chocolate can be output from spigot 333 from chocolate milk ice cubes. This should require little to no mixing since the constituent elements had not been separated in the freezing process.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

I claim:

1. The method of producing supercooled frozen segments of milk without the addition of non milk products comprising the steps of:

pouring milk free of non milk components into a horizontal mold divided into separate frozen milk forming compartments;

chilling said mold while in a horizontal position at a sufficient rate of cooling to prevent separation of milk components in said mold and produce a single solid segment of milk in each compartment; and continuing said chilling until the temperature of the milk in said mold is between minus 10° F. and minus 50° F. thereby producing supercooled segments of milk.

2. The method of claim 1 in which said segments of milk are removed by rapidly subjecting said supercooled milk segments to a short, temporary contact with a high heat source to melt a thin layer of frozen milk adjacent walls of said mold and rotating said mold to a substantially vertically oriented dump position whereby said segments of frozen milk are dumped from said mold into a collection bin.

3. The method of claim 2 in which said mold is tipped slightly during filling to discharge excess liquid milk into a trough, said mold being righted back into a horizontal position after said compartments are filled with milk for freezing.

4. The method of claim 2 in which said mold comprises an upper curved wall extending the length of said mold forming an upwardly facing concave surface divided into said compartments by a plurality of spaced separators and a lower curved wall forming an arcuate shaped passageway through the length of said mold, said upper and lower curved walls being joined at edges thereof.

5. Supercooled segments of frozen milk free of non milk components produced by the method of claim 1.

6. Supercooled segments of frozen milk free of non milk components made by the process of:

pouring milk free of non milk components into a horizontal mold divided into separate frozen milk forming compartments;

chilling said mold while in a horizontal position at a sufficient rate of cooling to prevent separation of components in said milk in said mold and produce a single solid segment of frozen milk in each compartment; and continuing said chilling until the temperature of the frozen segments of milk in said mold is between minus 10° F. and minus 50° F. thereby producing supercooled segments of frozen milk.

7. The method of producing supercooled segments of frozen milk free of non milk components in which non-water components are substantially uniformly distributed throughout the frozen milk segments comprising the steps of:

pouring water containing milk components free of non milk ingredients into a horizontal mold divided into separate ice forming compartments;

chilling said mold while in a horizontal position at a sufficient rate of cooling to prevent separation of the water in said mold and produce a single solid segment of frozen milk in each compartment; and continuing said chilling until the temperature of the frozen milk segments in said mold is between minus 10° F. and minus 50° F. thereby producing supercooled segments of frozen segments of milk.

8. The method of claim 7 in which said segments of frozen milk are removed by rapidly subjecting said supercooled milk segments to a short, temporary contact with a high heat source to melt a thin layer of milk adjacent wails of said mold and rotating said mold to a substantially vertically oriented dump position whereby said segments of milk are dumped from said mold into a collection bin.

9. The method of claim 7 in which said water containing milk components are selected farm the group consisting of whole milk, skim milk, lowfat milk, non-fat milk, reconstituted powdered milk, pasteurized milk and raw milk.

10. The method of claim 7 in which said water containing milk components is yogurt.

11. The method of claim 7 in which said mold is tipped slightly during filling to discharge excess liquid mixture into a trough, said mold being righted back into a horizontal position after said compartments are filled with milk for freezing.

12. The method of claim 7 in which said mold comprises an upper curved wall extending the length of said mold fanning an upwardly facing concave surface divided into said compartments by a plurality of spaced separators and a lower curved wall forming an arcuate shaped passageway through the length of said mold, said upper and lower curved walls being joined at edges thereof.

13. The method of claim 7 in which the supercooled segments of frozen milk are shipped into a bulk liquefaction and distribution center where said segments of frozen milk are liquefied and packaged for distribution to food stores.

14. A method of claim 7 in which the supercooled frozen segments of milk are rapidly liquefied for consumption comprising the steps of:

dumping said frozen segments into an ice shaver;

shaving said frozen segments of milk; and discharging the shaved frozen segments of milk into a liquefier for melting into potable liquid milk.

* * * * *